United States Patent [19]

Yasuda

[11] 4,215,093

[45] Jul. 29, 1980

[54] CATALYTIC CONVERTER

[75] Inventor: Hiroki Yasuda, Hachioji, Japan

[73] Assignee: Fuji Jukogyo Kabushiki Kaisha, Tokyo, Japan

[21] Appl. No.: 908,387

[22] Filed: May 22, 1978

[51] Int. Cl.[2] ..... B01J 35/04; B01J 8/02; F01N 3/15

[52] U.S. Cl. ..... 422/179; 29/157 R; 422/180

[58] Field of Search ..... 23/288 F, 288 FC; 60/282, 293, 299, 301, 302; 422/179, 180, 176

[56] References Cited

U.S. PATENT DOCUMENTS

| | | | |
|---|---|---|---|
| 3,600,142 | 8/1971 | Fessler | 23/288 F |
| 3,824,788 | 7/1974 | Cole et al. | 23/288 FC X |
| 3,854,888 | 12/1974 | Frietzche et al. | 23/288 F |
| 3,912,459 | 10/1975 | Kearsley | 23/288 FC |
| 4,043,761 | 8/1977 | Gaysert et al. | 23/288 FC |

FOREIGN PATENT DOCUMENTS

| | | | |
|---|---|---|---|
| 968970 | 6/1975 | Canada | 60/299 |
| 2308721 | 8/1974 | Fed. Rep. of Germany | 23/288 FC |
| 1357241 | 6/1974 | United Kingdom | 60/302 |
| 1405068 | 7/1975 | United Kingdom | 60/299 |

*Primary Examiner*—Barry S. Richman
*Attorney, Agent, or Firm*—Martin A. Farber

[57] ABSTRACT

A catalytic converter adapted for use in the exhaust system of internal combustion engines comprising a shell made of a pair of half shells forming an inlet chamber and a catalyst chamber, and a funnel-like outlet shell forming an outlet chamber. The inlet chamber has inlet ports communicating with exhaust pipes respectively and the outlet chamber has an outlet port communicating with a downstream exhaust pipe. The catalyst chamber resiliently supports a monolithic type catalyst element. The outlet shell which defines the outlet chamber is adapted to engage the inside of the pair of shells which form the catalyst chamber.

3 Claims, 6 Drawing Figures

1
2
3
4
5
26
32

2
3
4
8
9
10
11
12
13
14
16
17
18
25

CATALYTIC CONVERTER

BACKGROUND OF THE INVENTION

The present invention relates to a catalytic converter for removing noxious elements from the exhaust gas stream of the internal combustion engine.

There have been provided three kinds of converters, namely a reducing catalytic converter for elimination of nitrogen oxides, an oxidizing catalytic converter for the elimination of carbon monoxide and hydrocarbons, and a three-way converter for reacting the three noxious elements at the same time. The converter comprises a catalyst bed comprising a pellet type catalyst element or monolithic or honeycomb catalyst element. The monolithic catalyst element has a series of longitudinally oriented passages each which substantially has a quadrilateral section having a side length of about 1 to 1.6 mm, so that the exhaust gases may flow smoothly through the catalyst element with small back pressure. However, there is a problem that the reaction may not be sufficiently carried out to reduce each noxious component to the required level because of a short residence time of the gas flow.

SUMMARY OF THE INVENTION

It is the object of the present invention to provide a monolithic type catalytic converter in which the exhaust gases sufficiently contact the catalyst so as to effect a reaction enough to reduce the noxious components to the required level.

In accordance with the present invention, the monolithic type catalytic converter comprises a shell, the shell comprising a pair of half shells forming a catalyst chamber and an inlet chamber and a funnel-like outlet shell forming an outlet chamber, each of the half shells having a body shell for forming the catalyst chamber and an inlet shell for forming the inlet chamber, the outlet shell being adapted to engage the inside of the body shell, a monolithic catalyst element in said catalyst chamber, means for resiliently mounting said monolithic catalyst element in said catalyst chamber, a pair of inlet ports of said inlet chamber adapted to communicate with upstream exhaust pipes, and an outlet port of said outlet chamber adapted to communicate with a downstream exhaust pipe.

Other objects and advantages will be apparent as the present invention is hereinafter described in detail referring to the accompanying drawings, in which.

DETAILED DESCRIPTION OF THE INVENTION

Figure 1:
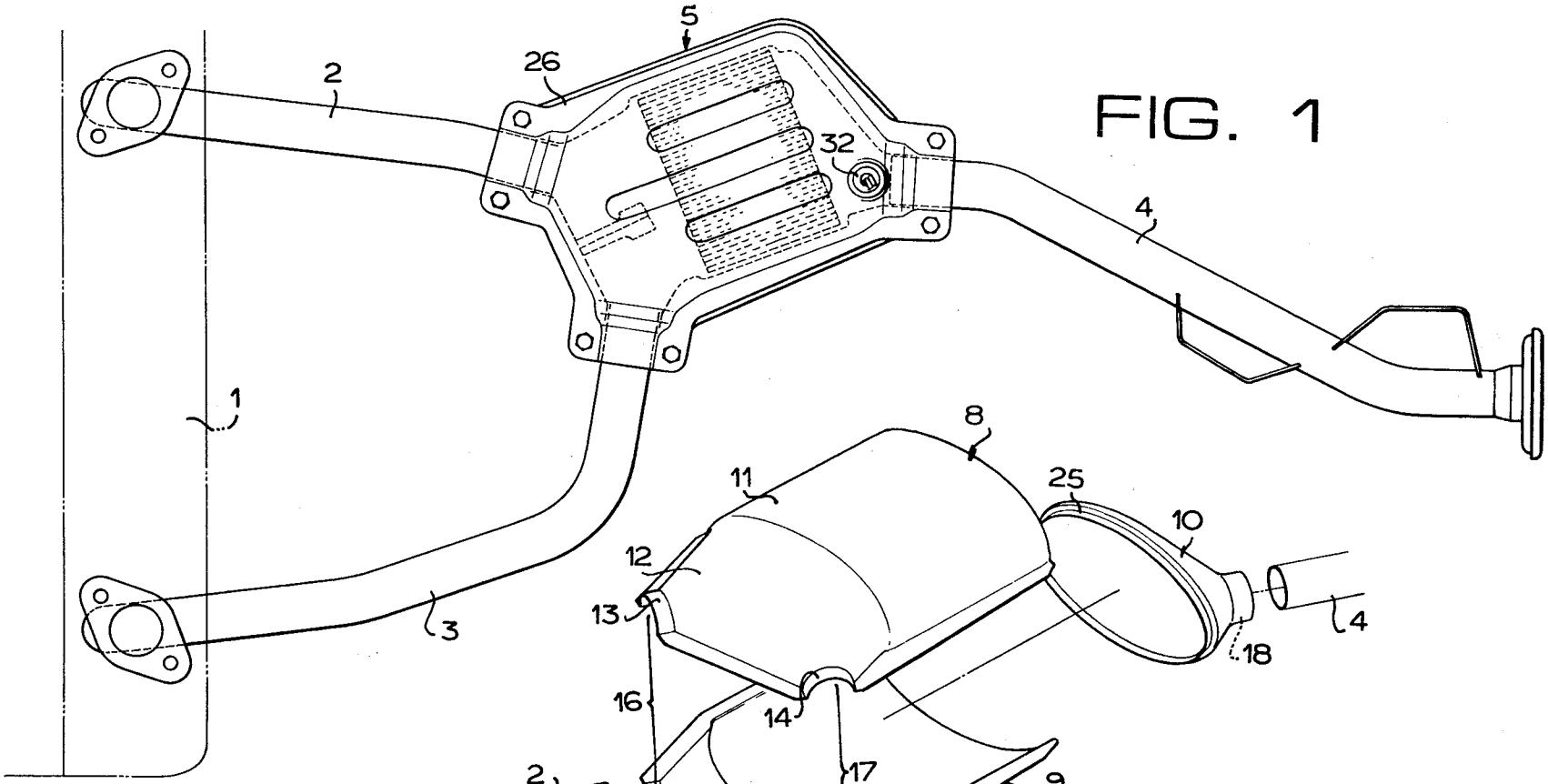
FIG. 1 is a plan view of an exhaust system embodying the present invention.
Figure 4:
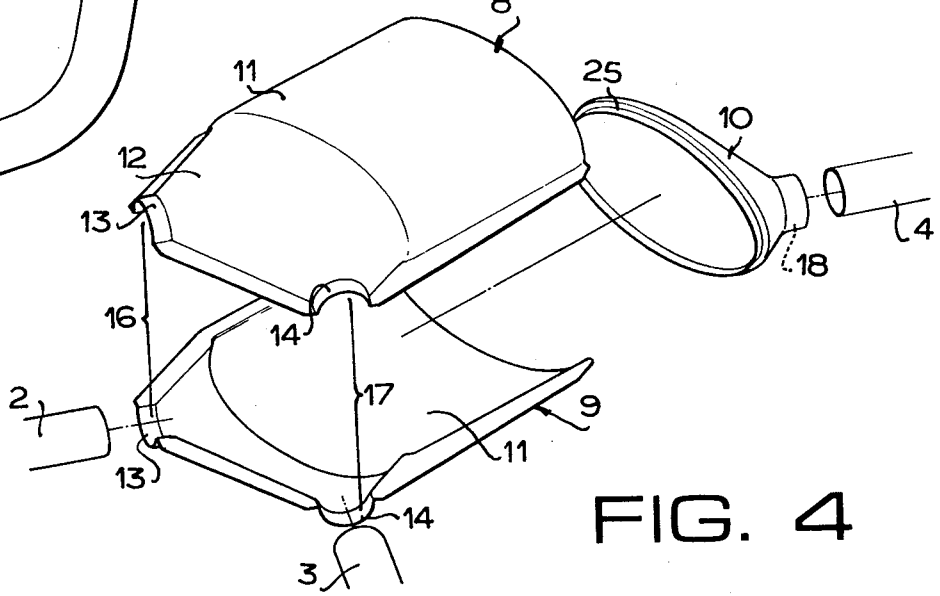
FIG. 4 is a perspective view of shells of the catalytic converter with the parts shown in disassembled relation.

Referring to FIG. 1, an exhaust system into which a catalytic converter of the present invention is applied comprises a bifurcated exhaust pipe comprising two upstream exhaust pipes 2 and 3 which are connected to a pair of exhaust ports of the engine 1 and a common downstream exhaust pipe 4. Such a bifurcated exhaust pipe, for example, is used in the horizontal opposed-cylinder type engine. At the concourse portion or bifurcation of the exhaust pipes, a catalytic converter 5 of the present invention is provided, connecting each end of the exhaust pipes 2 and 3 to an inlet of the catalytic converter and connecting the end of the common exhaust pipe 4 to an outlet thereof.

Figure 2:
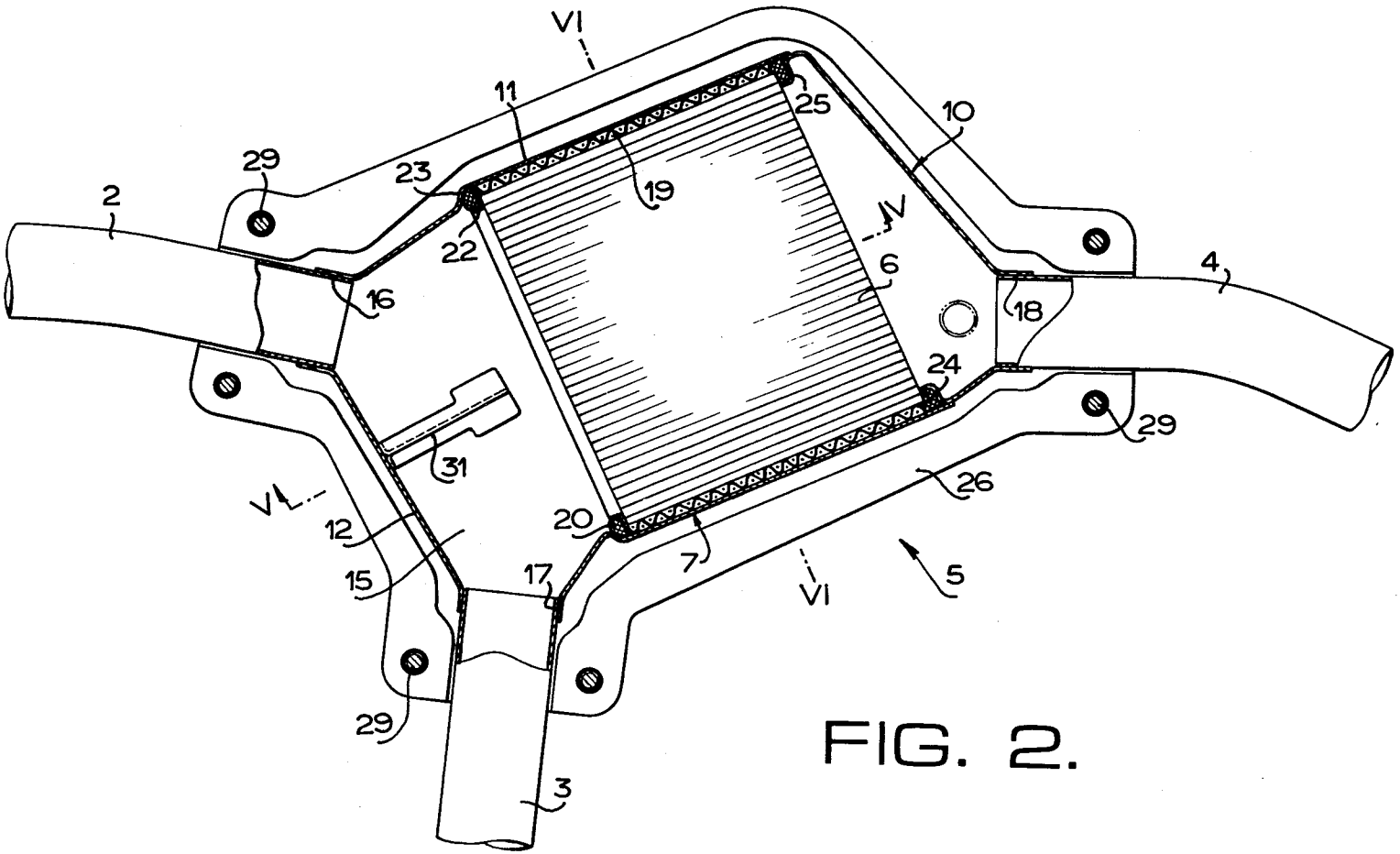
FIG. 2 is a sectional plan view of the catalytic converter shown in FIG. 1.
Figure 3:
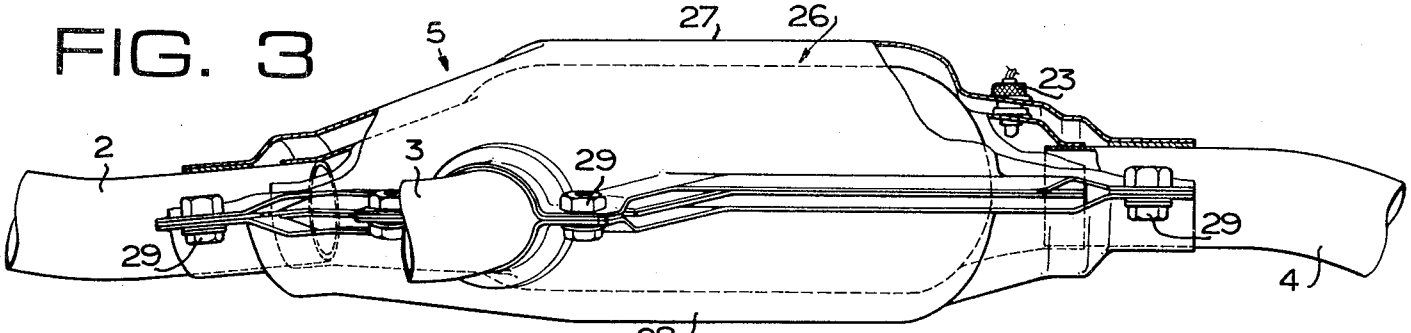
FIG. 3 is a side view of the catalytic converter.
Figure 5:
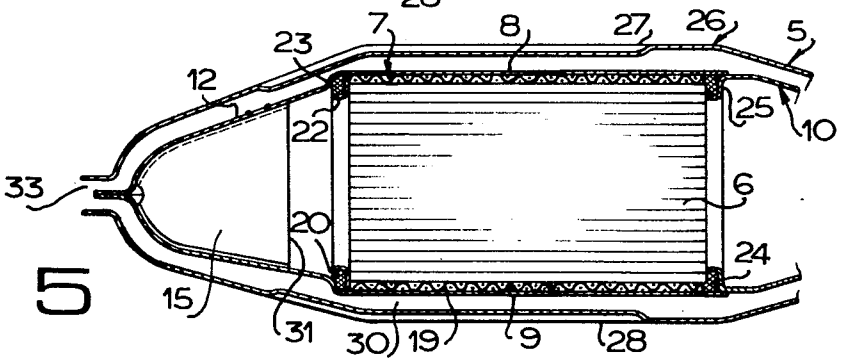
FIG. 5 is a sectional view taken along the line V—V in FIG. 2.
Figure 6:
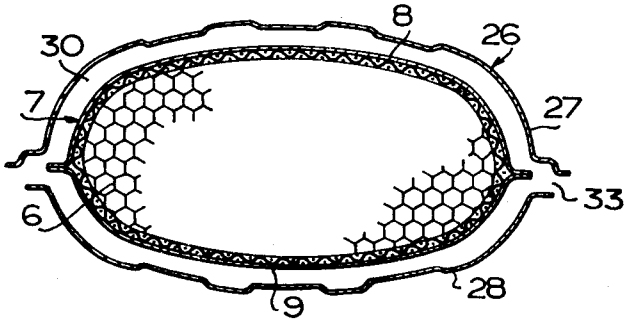
FIG. 6 is a sectional view taken along the line VI—VI in FIG. 2.

The catalytic converter 5 comprises a monolithic catalyst element 6 provided in a cylindrical shell 7 having an oval cross section, as shown in FIGS. 5 and 6. The catalyst is a monolithic three-way catalyst, but other types of catalyst may be used as the converter. The shell 7 comprises a pair of half shells 8 and 9 and a funnel-like outlet shell 10, each of which is made of stainless steel. Each of half shells 8 and 9 includes a body shell 11, a tapered inlet shell 12, and a pair of semicircular inlet portions 13 and 14. Thus, by joining both half shells 8 and 9 together, a catalyst chamber is formed by the body shells 11, an inlet chamber 15 is formed by the tapered inlet shells 12, and inlet ports 16 and 17 are formed by the semicircular inlet portions 13 and 14. Each axial line of the inlet ports 16 and 17 forms an angle with the axial line of the catalyst chamber, as shown in FIG. 2, so that the axial lines of both inlet ports cross each other in the inlet chamber 15. The funnel-like outlet shell 10 forms an outlet chamber and has an outlet port 18 which is off-set from the axial line of the catalyst chamber and makes an angle with the axial line.

The monolithic catalyst element 6 is wrapped by a wire mesh 19 and is maintained by a damper member 20 made of wire and an annular rim 22, which are disposed between the shoulder 23 of the body shell 11 and the catalyst element 6 and also is maintained by a damper member 24 disposed between the flange 25 which inwardly projects from the inner end of the outlet shell 10 and the catalyst element. In assembly, the damper member 20 combined with the annular rim 22 and the catalyst member 6 wrapped by the wire mesh 19 are engaged with one of the half shells 8 and 9 and the other half shell is joined and welded to the first-mentioned half shell. The damper member 24 is then inserted in the joined shell, and thereafter the outlet shell 10 is inserted into the joined shell so that the catalyst element 6 may be urged and pressed toward the damper member 20 by the flange 25 and the damper member 24. In the compressed condition, the half shells 8, 9 and the outlet shell 10 are welded to each other. Thus, the catalyst element 6 is supported in the shell 7 with the wire mesh 19, and the damper members 20, 24, so that movement of the catalyst member is prevented and the damper member 20 and the annular rim 22 serve as sealing members for preventing the exhaust gases from passing through the space between the catalyst element and the inner wall of the shell 7.

The upstream exhaust pipes 2 and 3 engage the inlet ports 16 and 17 and are welded thereto, respectively and the downstream exhaust pipe 4 engages the outlet port 18 of the outlet shell 10. The converter shell 7 is covered by a protective cover 26 comprising half members 27 and 28. The half members 27 and 28 are joined at the portions surrounding the exhaust pipes 2, 3 and 4 and are secured thereto by bolts 29. Peripheral edges of both half members 27, 28 are disposed apart from each other and there is provided a space 30 between the cover 26 and the shell 7. Thus, air may enter into the space 30 from the gap 33 between the edges of the half members 27 and 28, thereby cooling the converter during the operation. Further, a reinforcement 31 is provided in the inlet chamber 15 and a temperature sensitive element 32 is provided in the outlet shell 10 for detecting the temperature of the converter to prevent the burning of the catalyst element.

In operation, exhaust gases alternately enter into the inlet chamber 15 from the inlet ports 16 and 17. Since the axial lines of the inlet ports cross each other in the inlet chamber 15 as described above, exhaust gases from both inlet ports collide with each other to effect mixing of the gases. In addition, since each axial line of the inlet ports makes an angle with the end plane of the catalyst element 6, turbulence of the exhaust gases may occur to reduce the flow rate of the gases. Therefore, sufficient contact of the gases with the catalyst element may be accomplished. Further, the exhaust gases pass through each passage of the catalyst element with a zigzag flow pattern, because the exhaust gases enter the passage having an angle with the axial line of the passage, whereby exhaust gases are deflected by the inner wall of the passage and the deflection is repeated. The zigzag flow pattern will enhance the catalytic reaction in the converter as compared with a conventional converter in which the gases pass straight through the passage. In the outlet shell 10, the exhaust gas flow rate is reduced, since the outlet port 18 is off-set, whereby the residence time of the gases in the catalyst element may be further increased. Thus, a sufficient residence time of the exhaust gases in the catalyst element may be obtained to reduce the amount of noxious components to the required level.

The present invention provides further an advantageous converter which may be easily manufactured, which has a high gas sealing property and a large supporting force on the catalyst element as compared with the conventional converter as described hereinafter.

The conventional converter comprises four shell parts, namely a pair of half inlet shells corresponding to the tapered inlet shell 12 of the illustrated embodiment of the present invention, a cylindrical body shell corresponding to the body shell 11, and an outlet shell corresponding to the outlet shell 10. The converter of the present invention comprises three shell parts, and hence the welded length is shorter than the conventional one. In the conventional converter, the catalyst element must be inserted into the body shell, so that the wire mesh covering the catalyst element might be deformed during insertion. Therefore, the supporting force of the wire mesh on the element is decreased thereby deflecting the position of the element, which results in a decrease in the sealing effect for the gas flow.

In accordance with the present invention, the catalyst element can engage one of the half shells before assembling, after which the half shell may be joined to the this other one. Accordingly, the catalyst element may be positioned in the desired location without deformation of the wire mesh, thereby eliminating disadvantages due to the decrease of the sealing effect as in the conventional converter.

What is claimed is:

1. A catalytic converter for purifying the exhaust gases of internal combustion engine comprising a shell, said shell comprising a pair of half shells, each of said half shells having an inlet shell and a body shell, said body shells forming a catalyst chamber and said inlet shells forming a tapered inlet chamber, and a funnel-like outlet shell forming an outlet chamber, said outlet shell having a flange projecting radially and axially inwardly at an inner end thereof, a monolithic catalyst element in said catalyst chamber, resilient mounting means disposed on the periphery of said monolithic catalyst element in said catalyst chamber, said body shells form a shoulder adjacent said inlet shells, said shoulder comprising an annular inwardly directed portion integrally connecting said body shell with said inlet shell of each of said half shells, an annular rim having a substantially L-shaped cross-section disposed at a front end of said monolithic catalyst element and including a radial portion between said resilient mounting means and first resilient means and an axial portion, the latter defining an inlet for the exhaust gases into said monolithic catalyst element, first resilient means disposed between said radial portion of said annular rim and said shoulder of said body shells, second resilient means disposed between a rear end of said monolithic catalyst element and said flange of the outlet shell, said inlet shells defining a pair of inlet ports of said inlet chamber adapted to communicate with upstream exhaust pipes, and said outlet shell forming an outlet port of said outlet chamber adpated to communicate with a downstream exhaust pipe, said outlet shell being engaged with a rear end of said body shells, said flange being engaged with said second resilient means and the rear end of said monolithic catalyst element pressing the latter against said annular rim and said annular rim against said first resilient means, said first resilient means and said annular rim constituting sealing means for sealing a gap between the monolithic catalyst element and said body shells.

2. The catalytic converter as set forth in claim 1, wherein said first resilient means is made of wire, said first resilient means and said second resilient means preventing movement of said monolithic catalyst member.

3. The catalytic converter as set forth in claim 2, wherein said first resilient means, said monolithic catalyst element, and said resilient mounting means are initially engaged only with one of said half shells, the other of said half shells is joined and welded to said one of said half shells, and said outlet shell is inserted into and welded to said half shells at said rear end of said body shells in a compressed condition of said first and said second resilient means.

* * * * *